US012527423B2

(12) United States Patent
Arnold et al.

(10) Patent No.: US 12,527,423 B2
(45) Date of Patent: Jan. 20, 2026

(54) DEVICE FOR ASSISTING WITH CLOTHES MANAGEMENT FOR REDUCED-MOBILITY USERS

(71) Applicant: DigniTDevices, LLC, Buckeye, AZ (US)

(72) Inventors: Georgia Lee Arnold, Buckeye, AZ (US); Sally L. Martinez, Phoenix, AZ (US)

(73) Assignee: DigniTDevices, LLC, Buckeye, AZ (US)

( * ) Notice: Subject to any disclaimer, the term of this patent is extended or adjusted under 35 U.S.C. 154(b) by 0 days.

(21) Appl. No.: 19/242,080

(22) Filed: Jun. 18, 2025

(65) Prior Publication Data

US 2025/0380831 A1 Dec. 18, 2025

Related U.S. Application Data

(60) Provisional application No. 63/661,165, filed on Jun. 18, 2024.

(51) Int. Cl.
*A47G 25/90* (2006.01)

(52) U.S. Cl.
CPC ..... *A47G 25/90* (2013.01)

(58) Field of Classification Search
CPC ..... A41F 3/00; A41F 3/02; A41F 3/04; A41F 3/06; A41F 11/00; A41F 11/12;
(Continued)

(56) References Cited

U.S. PATENT DOCUMENTS 4,335,875 A * 6/1982 Elkin ..... A63B 69/0059 482/131
4,691,917 A * 9/1987 Battista ..... A63B 23/12 482/131

(Continued)

OTHER PUBLICATIONS

Fanwer, "Fawner Clip And Pull Dressing Aid—Metal Clip", Second Generation, 2Pcs, Dressing Aids For Disabled And Elderly, Seniors, Handicap People, Pregnant Women, Adjustable 26-41 Inches, Available Online at <https://www.gosupps.com/fanwer-clip-and-pull-dressing-aid-metal-clip-second-generation-2pcs-dressing-aids-for-disabled-and-elderly-seniors-handicap-people-pregnant-women-adjustable-26-41-inches.html>, Retrieved on Aug. 20, 2025, 6 pages.

(Continued)

*Primary Examiner* — F Griffin Hall
(74) *Attorney, Agent, or Firm* — NGUYEN TARBET IP LAW

(57) ABSTRACT

A device with ergonomic features for assisting with pulling up and releasing down bottom-wear of users with reduced mobility, compromised strength, and/or issues with dexterity while providing increased comfort when wearing the device for extended periods of time. The device includes a base component, configured to be placed over shoulders of the user, slot components extending from the ends of the base component, each having two holes, and two cords, each disposed through the holes of the slot components. Pulling one end of the cord shortens the usable length and pulling the other end of the cord lengthens the usable length. The device further includes clips disposed at an end of each cord, configured to clip onto and release from the bottom-wear. The device further includes anchoring tabs disposed at an end of each cord opposite the clips, configured to lock the usable length of the cord in place.

6 Claims, 8 Drawing Sheets

(58) Field of Classification Search
CPC ..... A41F 15/00; A41F 15/002; A47G 25/90; A47G 25/905
See application file for complete search history.

(56) References Cited

U.S. PATENT DOCUMENTS 5,172,429 A * 12/1992 Lucier ..... A41F 3/02 2/326
5,607,089 A * 3/1997 Strum ..... A45F 4/02 224/264
7,744,512 B2 * 6/2010 Clarke ..... A63B 21/0552 482/124
8,091,748 B2 * 1/2012 Whitlaw ..... A47G 25/90 223/111
8,209,779 B2 * 7/2012 Herman ..... A41F 3/00 2/326
9,414,705 B2 * 8/2016 Sclafani ..... A47G 25/90
10,292,517 B1 * 5/2019 Lawver ..... A41F 3/02
10,918,234 B1 * 2/2021 Lawver ..... A47G 25/905
2005/0205619 A1 * 9/2005 Morel ..... A47G 25/90 223/111
2010/0078450 A1 * 4/2010 Longhurst ..... A47G 25/90 223/111
2010/0258600 A1 * 10/2010 Pfistor ..... A47G 25/90 223/111
2011/0315724 A1 * 12/2011 Whitlaw ..... A47G 25/90 223/111

OTHER PUBLICATIONS

Healthman, "Clip And Pull Dressing Aid", Pants Assistant Device For Elderly, Handicapped, Pregnant Women, Available Online at <https://www.gosupps.com/healthman-clip-and-pull-dressing-aid-pants-assistant-device-for-elderly-handicapped-pregnant-women.html>, Retrieved on Aug. 20, 2025, 4 pages.
Reach Right Dressing Aid Kit By Easy to Use Products, Available Online at <https://www.rehabmart.com/product/easy-to-use-products-reach-right-dressing-aid-kit-51853.html?gad_source=1&gclid=CjwKCAiAmsurBhBvEiwA6e-WPFXuJxpOYH0_CpnNZwJjOF064eEz-rKyqluM0y9xpT07d3E9wzvWXhoCYoMQAvD_BWE>, Retrieved on Aug. 20, 2025, 15 pages.

* cited by examiner

DEVICE FOR ASSISTING WITH CLOTHES MANAGEMENT FOR REDUCED-MOBILITY USERS

CROSS-REFERENCE TO RELATED APPLICATIONS

This application is a non-provisional and claims benefit of U.S. Provisional Application No. 63/661,165 filed Jun. 18, 2024, the specification of which is incorporated herein in its entirety by reference.

FIELD OF THE INVENTION

The present invention is directed to a device for aiding in clothes management for end users with reduced-mobility, compromised strength and/or issues with dexterity.

BACKGROUND OF THE INVENTION

Patients and individuals with reduced mobility and compromised strength often find it difficult to put on and take off bottom-wear due to the wide range of motion and strength that these actions require. Some devices have been developed for aiding such reduced-mobility patients and individuals with these activities, typically comprising a component that attaches to the pants and a strap that is pulled on once the device is attached to pull the pants onto the body without needing to bend over. However, these devices still require a wide range of motion and arm strength due to the configuration of the strap that the end user needs to pull on. Furthermore, the clips of these prior devices that attach to the pants are generally small and difficult to open, requiring a decent amount of hand strength and dexterity to actuate. These prior devices are simply not viable options for end users with reduced arm mobility and strength and/or arthritis or other diseases. Thus, there exists a present need for a clothes management device for aiding individuals with putting on and taking off bottom-wear while minimizing the range of motion, dexterity, and strength required for use.

BRIEF SUMMARY OF THE INVENTION

It is an objective of the present invention to provide devices and methods that allow for aiding in clothes management for reduced-mobility, compromised strength and/or issues with dexterity end users, as specified in the independent claims. Embodiments of the invention are given in the dependent claims. Embodiments of the present invention can be freely combined with each other if they are not mutually exclusive.

The present invention features a device with ergonomic features for assisting with pulling up and releasing down bottom-wear from a user. The device may comprise a base component, configured to be placed over the shoulders of the user. The device may further comprise slot components extending from the ends of the base component, each comprising two holes. The device may further comprise two cords, each having a first end and a second end. Each cord may be disposed through the holes of the slot components. A usable length of each cord may extend from one of the holes such that pulling one end of the cord shortens the usable length of the cord and pulling the other end of the cord lengthens the usable length of the cord. The device may further comprise clips disposed at an end of each cord, configured to clip onto the bottom-wear. The device may further comprise anchoring tabs disposed at an end of each cord opposite the clips, configured to lock the usable length of the cord in place.

One of the unique and inventive technical features of the present invention is the implementation of an attachment device configured to be worn by a user and attached to bottom-wear. Without wishing to limit the invention to any theory or mechanism, it is believed that the technical feature of the present invention advantageously provides for the ability to provide dressing support that can be applied to any bottom-wear owned by a user. None of the presently known prior references or works have the unique inventive technical feature of the present invention.

Furthermore, this inventive technical feature is counterintuitive. The reason that this inventive technical feature is counterintuitive is because it contributed to a surprising result. One of ordinary skill in the art would expect that a catch-all attachment device would be cumbersome to apply to bottom-wear and would bring about the same problems as the clothes on their own, instead implementing a garment having built-in components for ease-of-dressing capabilities. The present invention implements an over-the-shoulder base component and clip-cord attachment components that can be applied to any bottom-wear. Surprisingly, this allows for the ability to provide dressing support that can be applied to any bottom-wear owned by a user. Thus, the inventive technical feature of the present invention contributed to a surprising result.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWING(S)

The features and advantages of the present invention will become apparent from a consideration of the following detailed description presented in connection with the accompanying drawings in which.

DETAILED DESCRIPTION OF THE INVENTION

Figure 1A:
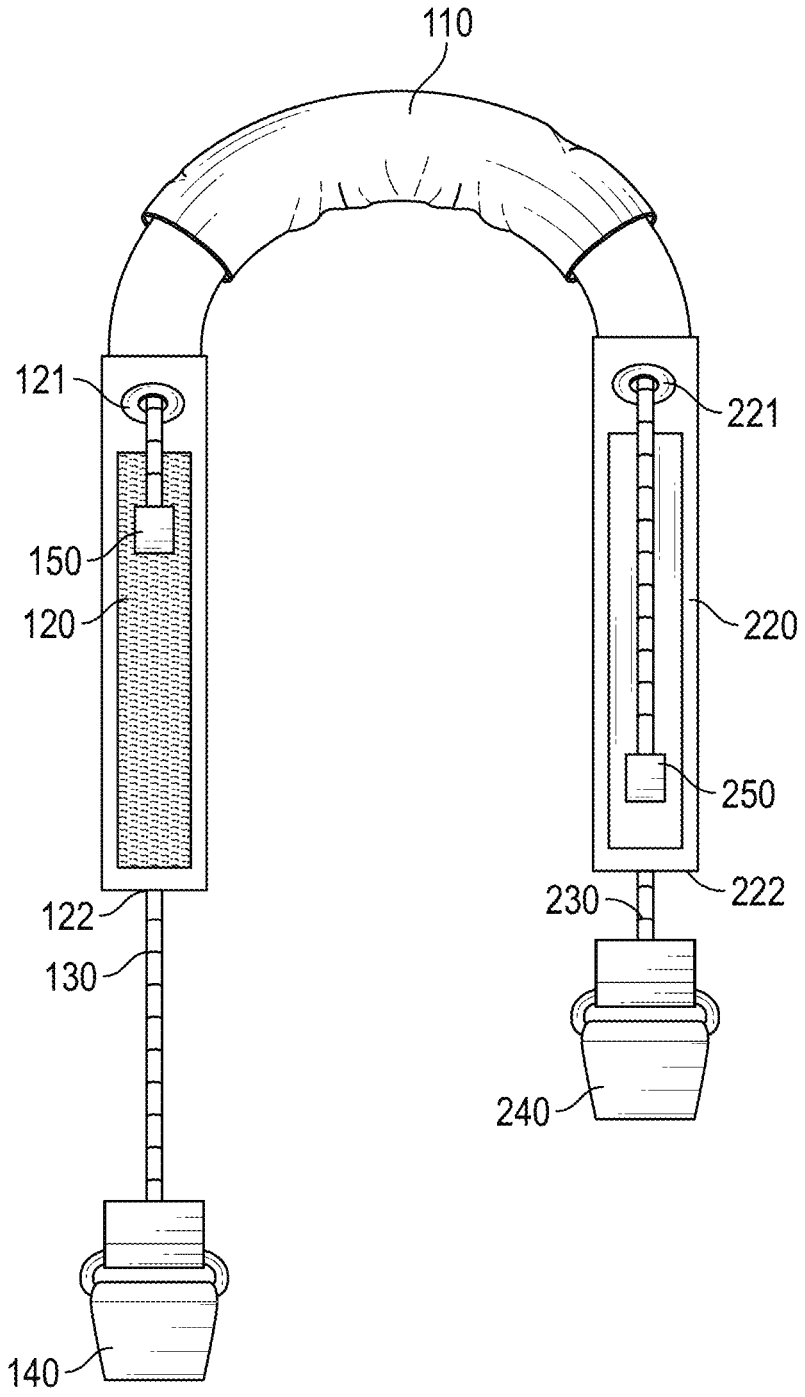
FIG. 1A shows a schematic diagram of the device for assisting with pulling up and releasing down bottom-wear of the present invention.

The following is a list of elements corresponding to a particular element referred to herein:

100 system
110 base component
120 first slot component
121 first hole
122 second hole
130 first cord
140 first clip
150 first anchoring tab
220 second slot component
221 first hole
222 second hole
230 second cord
240 second clip
250 second anchoring tab
1000 user
2000 bottom-wear The term "bottom-wear" is defined herein as any article of clothing designed to cover at least a portion of a person's lower half (e.g., pelvis, legs, feet).

The term "usable length" is defined herein as a length of cord able to span from the device to the user's bottom-wear.

Figure 1B:
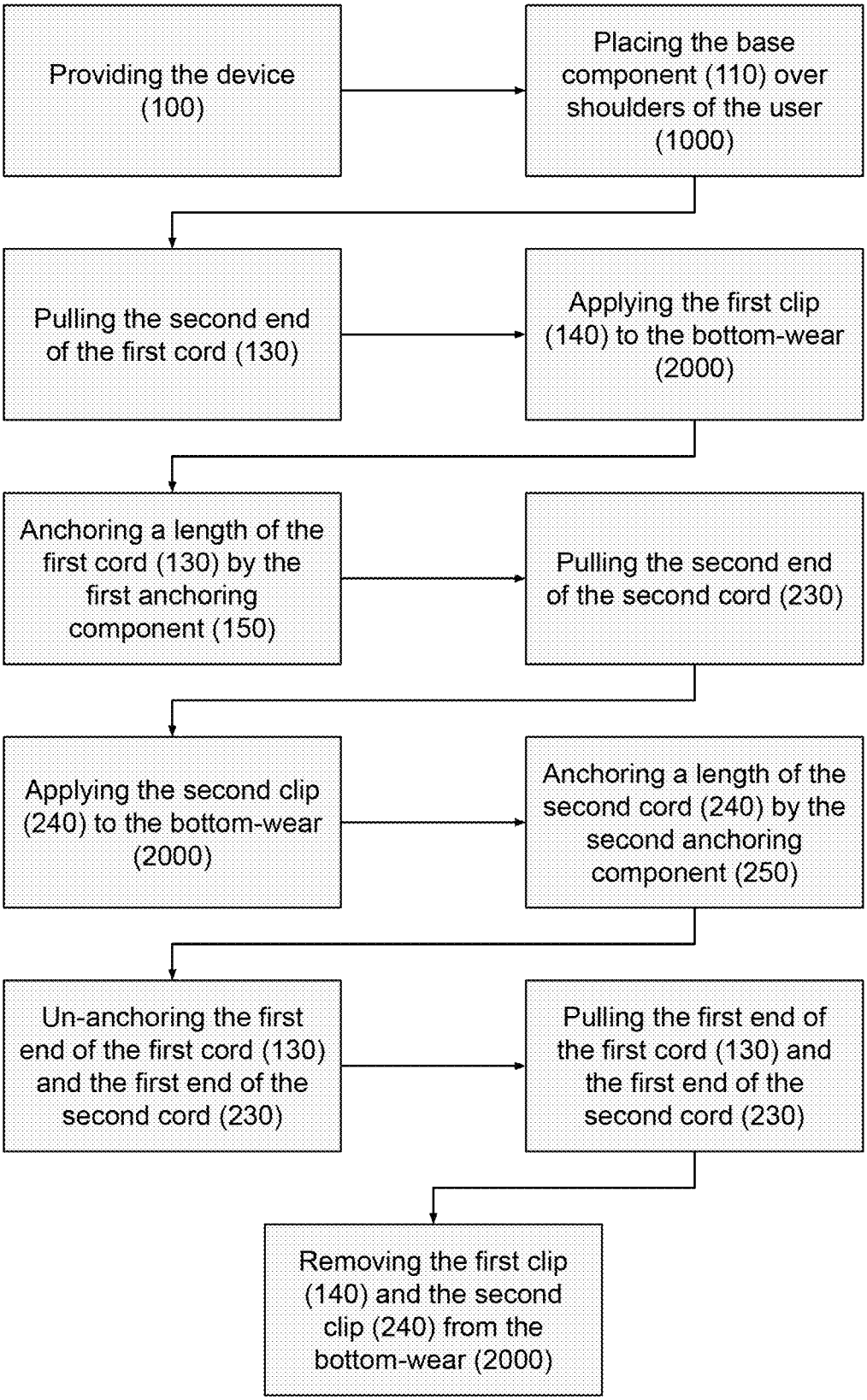
FIG. 1B shows a flow chart of a method for assisting with pulling up and releasing down bottom-wear of the present invention.

Referring now to FIGS. 1A-1B, the present invention features a device (100) with ergonomic features for assisting with pulling up and releasing down the bottom-wear (2000) of a user (1000). In some embodiments, the device (100) may comprise a base component (110) having a first end and a second end, configured to be placed over shoulders of the user (1000). The device (100) may further comprise a first slot component (120) extending from the first end of the base component (110), comprising a first hole (121) and a second hole (122). The device (100) may further comprise a first cord (130) having a first end and a second end. The first end of the first cord (130) may be disposed through the first hole (121) of the first slot component (120). The second end of the first cord (130) may be disposed through the second hole (122) of the first slot component (120). A usable length of the first cord (130) may extend from the second hole (122) of the first slot component (120) such that pulling the first end of the first cord (130) shortens the usable length of the first cord (130) and pulling the second end of the first cord (130) lengthens the usable length of the first cord (130). The device (100) may further comprise a first clip (140) disposed at the second end of the first cord (130), configured to clip onto the bottom-wear (2000). The device (100) may further comprise a first anchoring tab (150) disposed at the first end of the first cord (130), configured to lock the usable length of the first cord (130) in place.

The device (100) may further comprise a second slot component (220) extending from the second end of the base component (110), comprising a first hole (221) and a second hole (222). The device (100) may further comprise a second cord (230) having a first end and a second end. The first end of the second cord (230) may be disposed through the first hole (221) of the second slot component (220). The second end of the second cord (230) may be disposed through the second hole (222) of the second slot component (220). A usable length of the second cord (230) may extend from the second hole (222) of the second slot component (120) such that pulling the first end of the second cord (230) shortens the usable length of the second cord (230) and pulling the second end of the second cord (230) lengthens the usable length of the second cord (230). The device (100) may further comprise a second clip (240) disposed at the second end of the second cord (230), configured to clip onto the bottom-wear (2000). The device (100) may further comprise a second anchoring tab (250) disposed at the first end of the second cord (230), configured to lock the usable length of the second cord (230) in place.

In some embodiments, pulling and releasing the first end of the first cord (130) and pulling and releasing the first end of the second cord (230) may involve a minimized range of motion and minimal strength. In some embodiments, clipping and unclipping the first clip (140) and the second clip (240) to the bottom-wear (2000) may involve a minimized amount of force and minimal dextrous motion to open and close the clip. In some embodiments, the first slot component (120) may further comprise a first hook component and the second slot component (220) may further comprise a second hook component. The first anchoring tab (150) may comprise a first loop component configured to attach to the first hook component. The second anchoring tab (250) may comprise a second loop component configured to attach to the second hook component. In some embodiments, the first anchoring tab (150) may comprise a first hook-and-loop mechanism. In some embodiments, the second anchoring tab (250) may comprise a second hook-and-loop mechanism. In some embodiments, the hook components, the loop components, the hook-and-loop mechanisms, or a combination thereof may comprise Velcro®. In some embodiments, the first anchoring tab (150), the second anchoring tab (250), or a combination thereof may comprise buckles, adhesives, snap-buttons, a hook-and-eye mechanism comprising one or more J-hooks and one or more holes configured to accept the one or more J-hooks, or a combination thereof.

In some embodiments, the first cord (130) may comprise one or more plug components disposed along a length of the first cord (130), configured to block the first cord (130) from pulling through the first hole (121), the second hole (122), or a combination thereof. In some embodiments, the second cord (230) may comprise one or more plug components disposed along a length of the second cord (230), configured to block the second cord (230) from pulling through the first hole (221), the second hole (222), or a combination thereof.

In some embodiments, the base component (110) comprises a moveable fleece casing configured to reduce contact and friction of the base component (110) against the shoulders and neck of the user (1000). In some embodiments, the device (100) may be configured to be continuously worn. In some embodiments, the device (100) may be used for partially pulling or releasing on pants, underwear, (i.e. bottom-wear), or a combination thereof (e.g. when using the bathroom). In some embodiments, the device (100) may be configured to hold pants, underwear, or a combination thereof up partially. In some embodiments, the device (100) may be used for pulling up and releasing pants, underwear, or a combination thereof.

Referring now to FIG. 1B, the present invention features a method for assisting with pulling up and releasing down bottom-wear (2000) onto a user (1000). In some embodiments, the method may comprise providing a device (100). In some embodiments, the device (100) may comprise a base component (110) having a first end and a second end. The device (100) may further comprise a first slot component (120) extending from the first end of the base component (110), comprising a first hole (121) and a second hole (122). The device (100) may further comprise a first cord (130) having a first end and a second end. The first end may be disposed through the first hole (121) of the first slot component (120) and the second end is disposed through the second hole (122) of the first slot component (120). The device (100) may further comprise a first clip (140) disposed at the second end of the first cord (130). The device (100) may further comprise a first anchoring tab (150) disposed at the first end of the first cord (130). The device (100) may further comprise a second slot component (220) extending from the second end of the base component (110), comprising a first hole (221) and a second hole (222). The device (100) may further comprise a second cord (230) having a first end and a second end. The first end may be disposed through the first hole (221) of the second slot component (220) and the second end is disposed through the second hole (222) of the second slot component (220). The device (100) may further comprise a second clip (240) disposed at the second end of the second cord (230). The device (100) may further comprise a second anchoring tab (250) disposed at the first end of the second cord (230).

The method may further comprise placing the base component (110) over shoulders of the user (1000). The method may further comprise pulling the second end of the first cord (130) such that the first clip (140) reaches the bottom-wear (2000). The method may further comprise applying the first clip (140) to the bottom-wear (2000). The method may further comprise pulling the second end of the second cord (230) such that the second clip (240) reaches the bottom-wear (2000). The method may further comprise applying the second clip (240) to the bottom-wear (2000). The method may further comprise pulling the first end of the first cord (130) and the first end of the second cord (230) such that the bottom-wear (2000) is pulled up onto the user (1000). The method may further comprise anchoring a length of the first cord (130) by the first anchoring tab (150). The method may further comprise anchoring a length of the second cord (240) by the second anchoring tab (250).

In some embodiments, pulling and releasing the first end of the first cord (130) and pulling and releasing the first end of the second cord (230) may involve a minimized range of motion. In some embodiments, clipping and unclipping the first clip (140) and the second clip (240) to the bottom-wear (2000) may involve a minimized amount of force. In some embodiments, the first cord (130) may comprise one or more plug components disposed along a length of the first cord (130), configured to block the first cord (130) from pulling through the first hole (121), the second hole (122), or a combination thereof. In some embodiments, the second cord (230) may comprise one or more plug components disposed along a length of the second cord (230), configured to block the second cord (230) from pulling through the first hole (221), the second hole (222), or a combination thereof. In some embodiments, the base component (110) is configured to reduce contact and friction of the base component (110) against the shoulders and neck of the user (1000). In some embodiments, the device (100) may be configured to be continuously worn.

The present invention features a device (100) with ergonomic features for assisting with pulling up and releasing down bottom-wear (2000) onto a user (1000). In some embodiments, the device (100) may comprise a base component (110), configured to be placed over shoulders of the user (1000). The device (100) may further comprise one or more slot components (120) extending from the base component (110). The device (100) may further comprise one or more cords (130) movably disposed within the one or more slot components (120). The device (100) may further comprise one or more attachment components (140) coupled to the one or more cords (130), configured to attach to the bottom-wear (2000). The one or more cords (130), when pulled, may be configured to pull the bottom-wear (2000) up onto the user (1000).

Figure 1C:
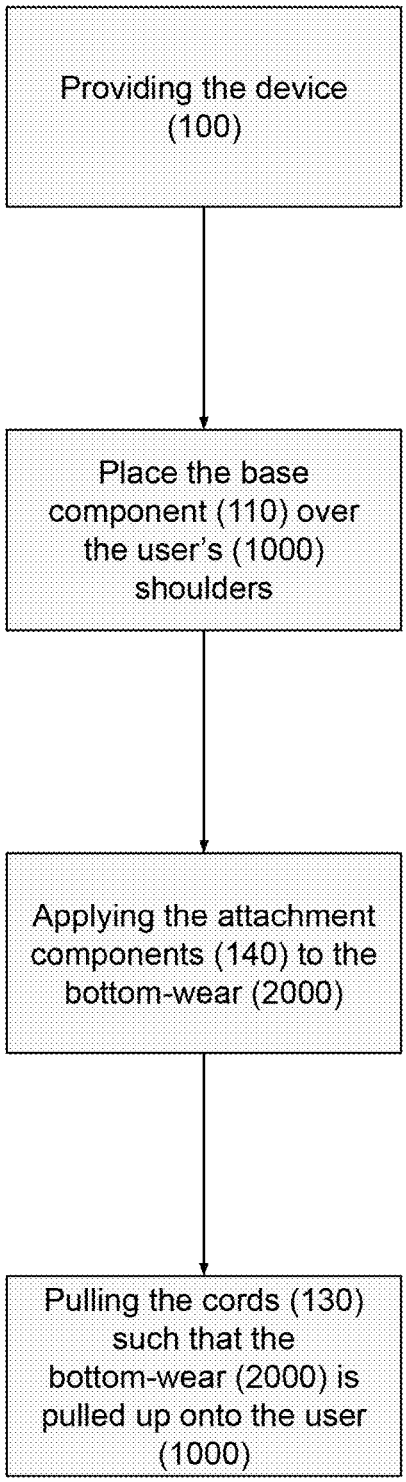
FIG. 1C shows a flow chart of an alternate method for assisting with pulling up bottom-wear of the present invention.

Referring now to FIG. 1C, the present invention features a method for assisting with pulling up and releasing down bottom-wear (2000) of a user (1000). In some embodiments, the method may comprise providing an attachment device (100). The attachment device (100) may comprise a base component (110), configured to be placed over shoulders of the user (1000). The device (100) may further comprise one or more cords (130) movably disposed relative to the base component (110). The device (100) may further comprise one or more attachment components (140) coupled to the one or more cords (130). The method may further comprise placing the base component (110) over shoulders of the user (1000). The method may further comprise applying the one or more attachment components (140) to the bottom-wear (2000). The method may further comprise pulling the one or more cords (130) such that the bottom-wear (2000) is pulled up onto the user (1000).

In some embodiments, pulling and releasing the one or more cords (130) may involve a minimized range of motion and strength. In some embodiments, applying the one or more attachment components (140) to the bottom-wear (2000) may involve a minimized amount of force and a minimized amount of dextrous motion. In some embodiments, the device (100) may further comprise one or more anchoring tabs. Each anchoring tab may be coupled to each cord of the one or more cords (130) at an end opposite the one or more attachment components. In some embodiments, the anchoring tabs may comprise hook-and-loop mechanisms. In some embodiments, the base component (110) may comprise a movable fleece casing configured to reduce contact and friction of the base component (110) against the shoulders and neck of the user (1000). In some embodiments, the device (100) may be configured to be continuously worn. In some embodiments, the device (100) may further comprise one or more slot components (120) extending from the base component (110) such that the one or more cords (130) are movably disposed in the one or more slot components (120). In some embodiments, the one or more attachment components (140) may comprise one or more clips.

Figure 1D:
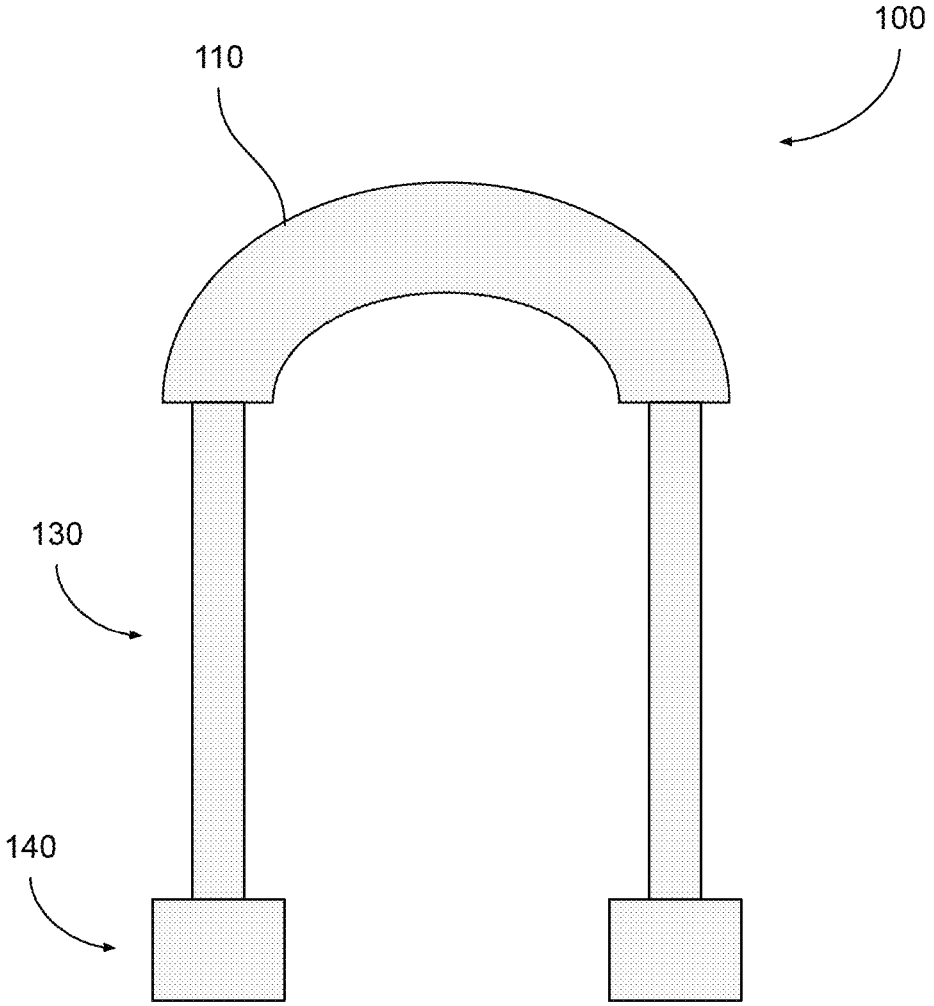
FIG. 1D shows a schematic diagram of an alternate embodiment of the device for assisting with pulling up and releasing down bottom-wear of the present invention.
Figure 2A:
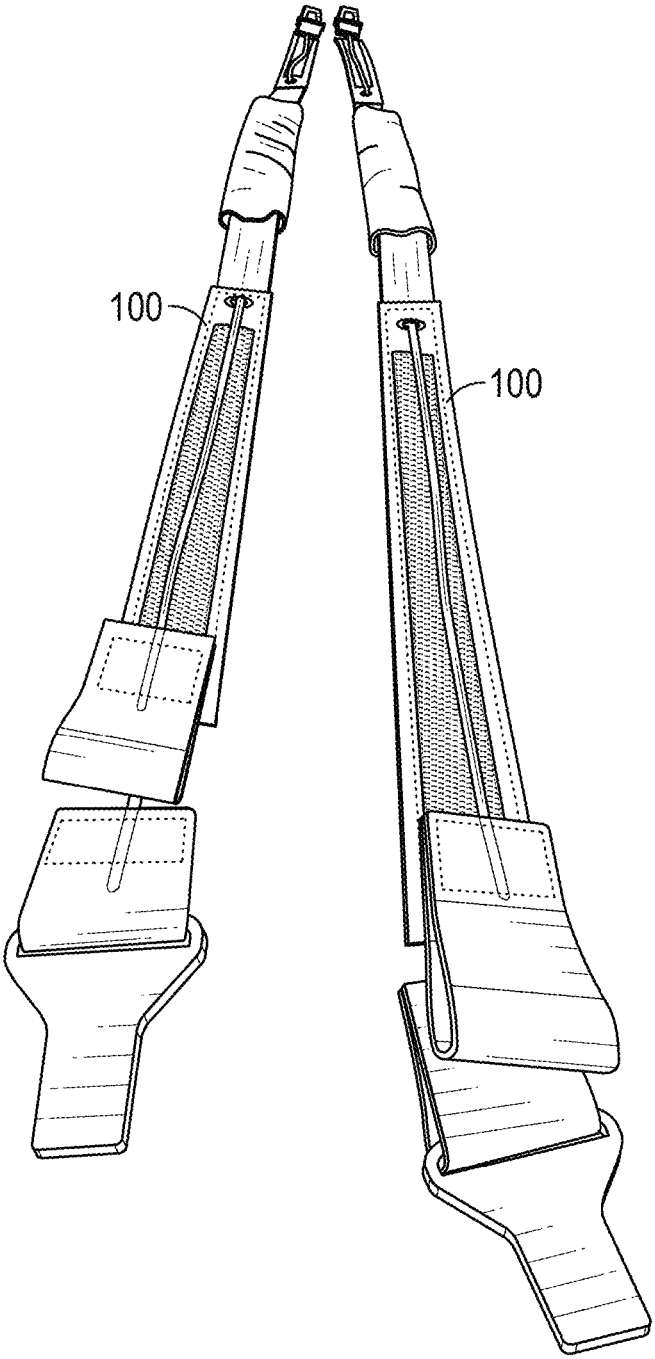
FIG. 2A shows a view of two instances of the device of the present invention laid out side-by-side.
Figure 2B:
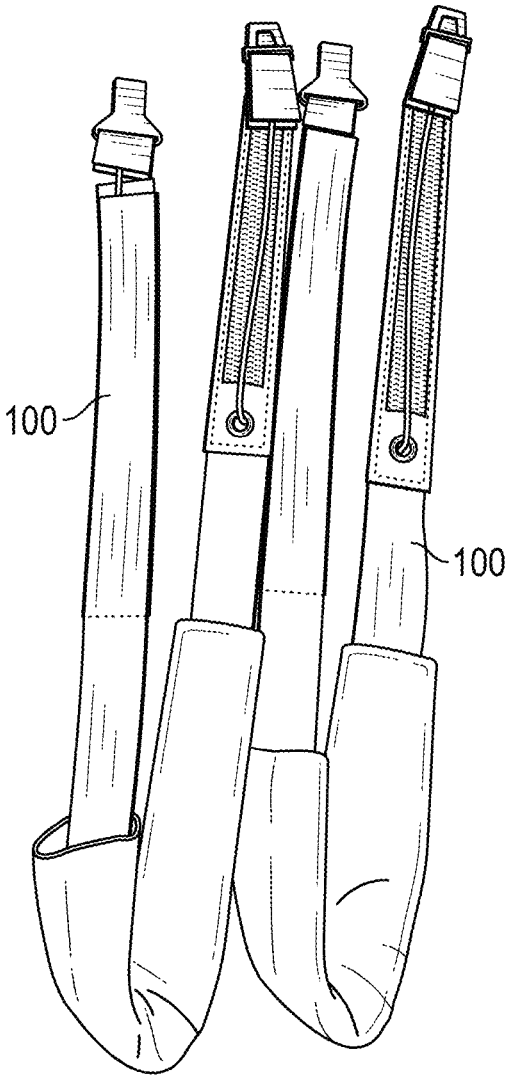
FIG. 2B shows a view of two instances of the device of the present invention folded side-by-side.
Figure 3A:
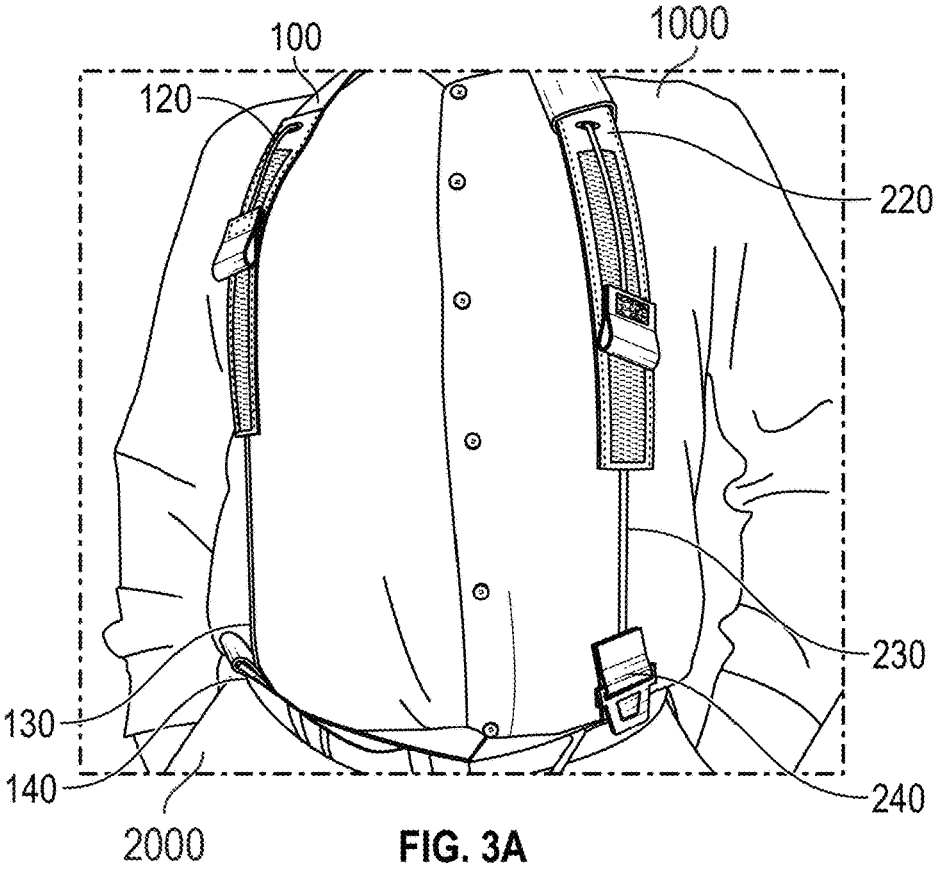
FIG. 3A shows a front view of the device of the present invention being worn.
Figure 3B:
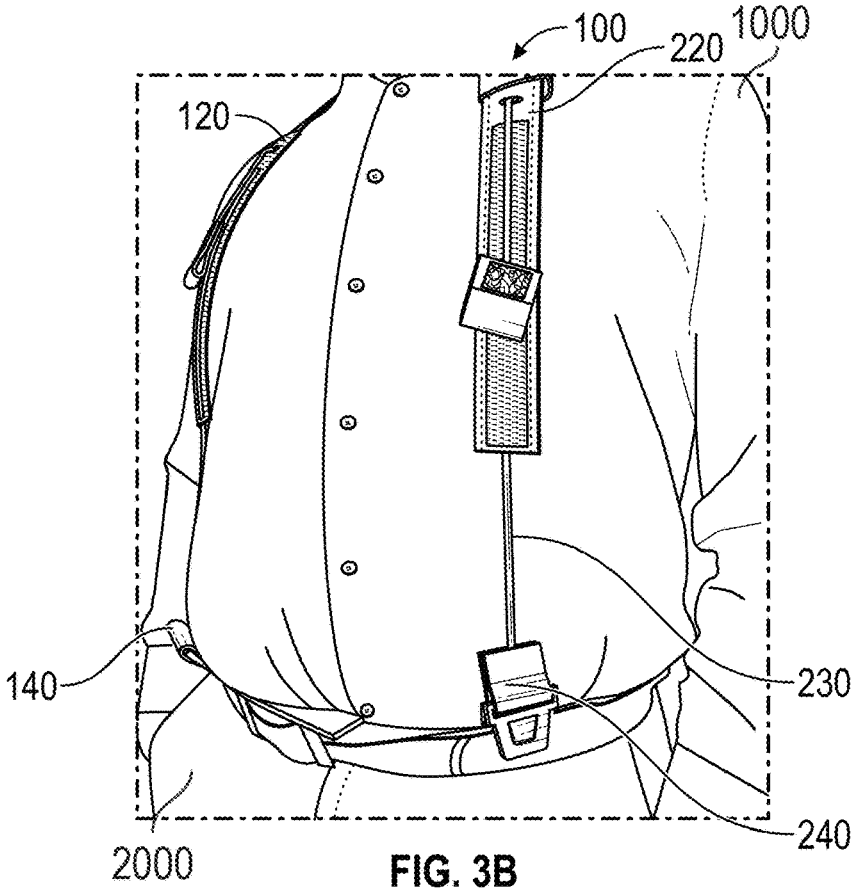
FIG. 3B shows an isometric view of the device of the present invention being worn.
Figure 4A:
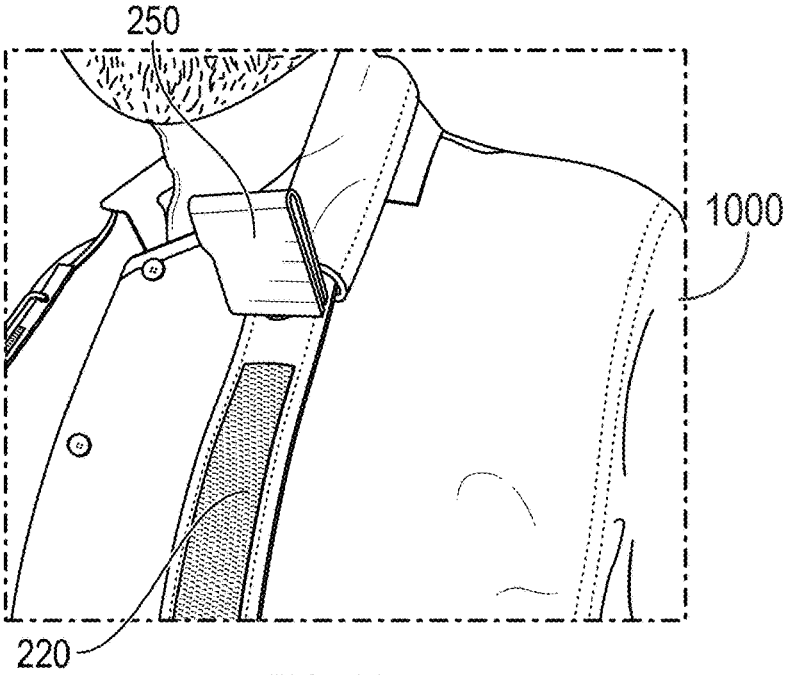
FIG. 4A shows a close-up view of a cord of the device of the present invention fully retracted into the slot component when bottom-wear is released.
Figure 4B:
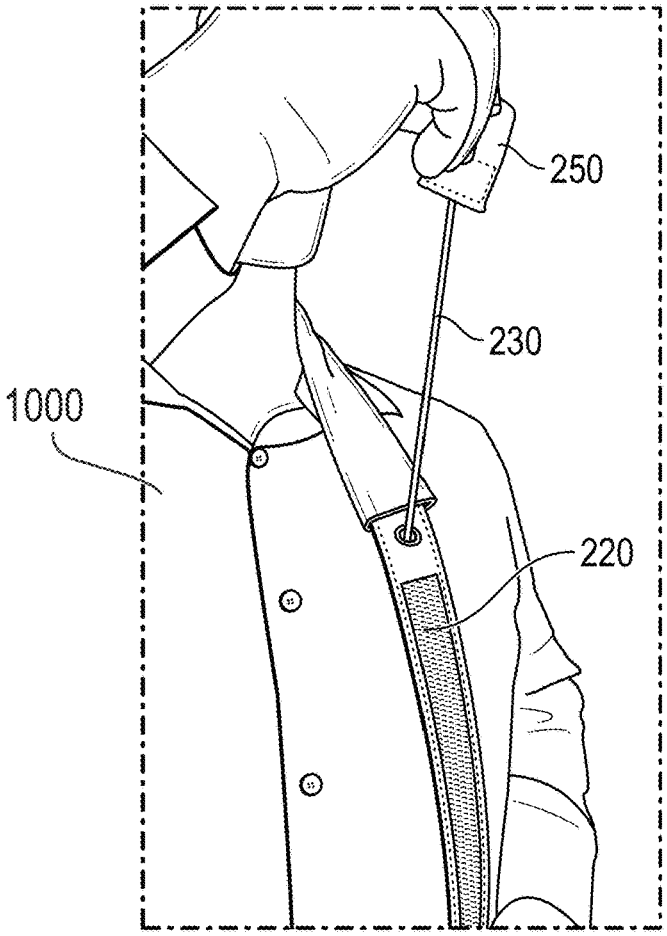
FIG. 4B shows a close-up view of the cord of the device of the present invention being pulled such that the other end of the cord is pulled up to aid the user in putting on bottom-wear.
Figure 5:
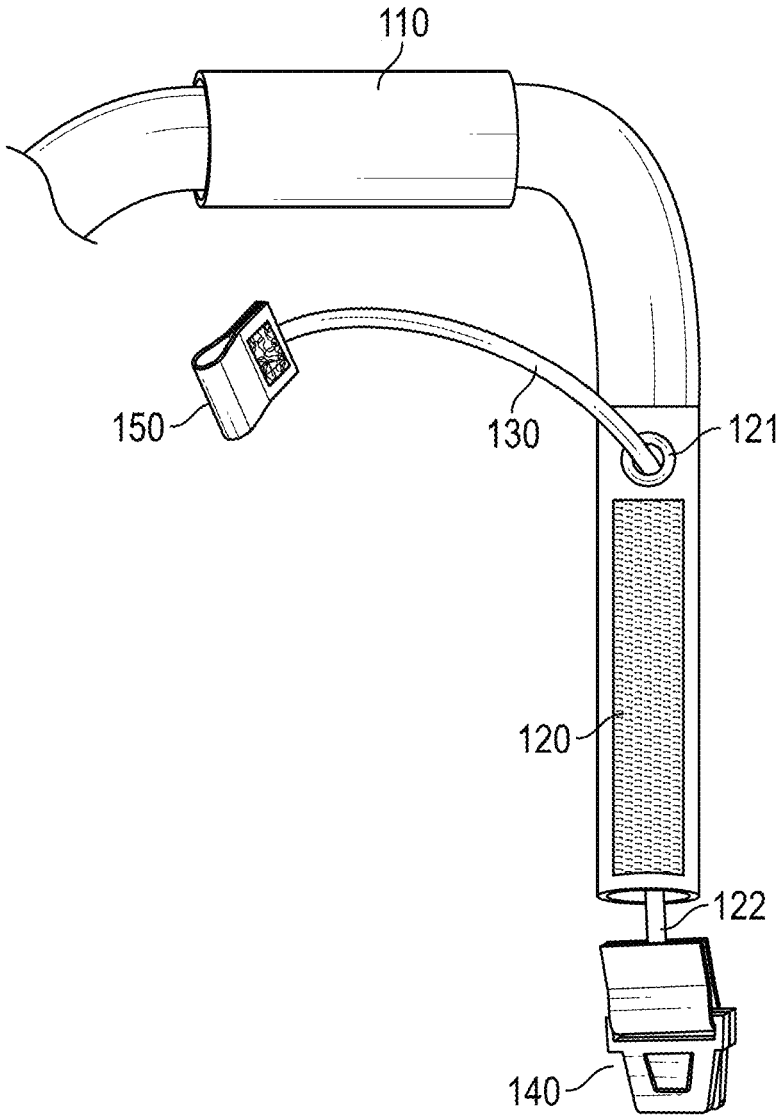
FIG. 5 shows a close-up view of the device for assisting with pulling up bottom-wear of the present invention.

Referring now to FIG. 1D, the present invention features an attachment device (100) with ergonomic features for assisting with pulling up and releasing down bottom-wear (2000) of a user (1000). The device (100) may comprise a base component (110), configured to be placed over shoulders of the user (1000). The device (100) may further comprise one or more cords (130) movably disposed relative to the base component (110). The device (100) may further comprise one or more attachment components (140) coupled to the one or more cords (130), configured to attach to the bottom-wear (2000). The one or more cords (130), when pulled, may be configured to pull the bottom-wear (2000) up onto the user (1000).

In some embodiments, the device (100) may further comprise one or more slot components (120) extending from the base component (110) such that the one or more cords (130) are movably disposed in the one or more slot components (120). In some embodiments, the one or more attachment components (140) may comprise one or more clips.

In some embodiments, the device of the present invention may be used to pull up and release down the undergarments of the user. In some embodiments, the first clip (140), the second clip (240), or a combination thereof may be clipped onto the undergarments. The base component (110) may then be lifted around the user's shoulders, thus lifting the undergarments onto the user. For releasing the undergarments down, the process may be reversed where the base component (110) is removed from the user's shoulders and the undergarments are released down. In some embodiments, the attachment components may be affixed to both the undergarments and the bottom-wear (2000) of the user. In some embodiments, the bottom-wear may comprise pants, shorts, skirts, undergarments, stockings, tights, or a combination thereof.

In some embodiments, the base component may comprise an elastic interior. In other embodiments, the base component may comprise a non-elastic interior. In some embodiments, a material of the base component may comprise cotton webbing, nylon webbing, fleece, any other flexible material, or a combination thereof. In some embodiments, a material of the one or more slot components may comprise cotton, nylon, any other flexible material, or a combination thereof. In some embodiments, the one or more cords may comprise elastic, nylon, any other flexible material, or a combination thereof. In some embodiments, the one or more cords may comprise a non-elastic material. In some embodiments, the tabs may comprise a different color from the slot components to add contrast and make the tabs easier for individuals to easily identify.

In some embodiments, the one or more attachment components may comprise clips, hooks (i.e., for hooking onto belt loops), a hook-and-loop mechanism (i.e., Velcro™), or a combination thereof. In some embodiments, the one or more attachment components may comprise a metal material, a plastic material, a wood material, or any other rigid material.

In some embodiments, the one or more anchoring tabs may comprise a hook-and-loop mechanism. In some embodiments, the tab may comprise a plurality of small hooks and the corresponding slot may comprise a strip of fabric comprising a plurality of loops such that the plurality of small hooks hook into the plurality of loops. In other embodiments, the tab may comprise a strip of fabric comprising a plurality of loops and the corresponding slot may comprise a plurality of small hooks such that the plurality of small hooks hook into the plurality of loops. In some embodiments, each anchoring tab may comprise a hook and each corresponding slot may comprise a plurality of loops disposed along the slot. The hook may be configured to be secured in one of the loops such that the usable length is fixed.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. An attachment device (100) with ergonomic features for assisting with pulling up and releasing down bottom-wear (2000) of a user (1000), the device (100) comprising:

a. a base component (110) having a first end and a second end, configured to be placed over shoulders of the user (1000);

b. a first slot component (120) extending from the first end of the base component (110), comprising a first hole (121) and a second hole (122);

c. a first cord (130) having a first end and a second end, wherein the first end is disposed through the first hole (121) of the first slot component (120) and the second end is disposed through the second hole (122) of the first slot component (120);

wherein a usable length of the first cord (130) extends from the second hole (122) of the first slot component (120) such that pulling the first end of the first cord (130) shortens the usable length of the first cord (130) and pulling the second end of the first cord (130) lengthens the usable length of the first cord (130);

d. a first clip (140) disposed at the second end of the first cord (130), configured to clip onto the bottom-wear (2000);

e. a first anchoring tab (150) disposed at the first end of the first cord (130), configured to lock the usable length of the first cord (130) in place;

f. a second slot component (220) extending from the second end of the base component (110), comprising a first hole (221) and a second hole (222);

g. a second cord (230) having a first end and a second end, wherein the first end is disposed through the first hole (221) of the second slot component (220) and the second end is disposed through the second hole (222) of the second slot component (220);

wherein a usable length of the second cord (230) extends from the second hole (222) of the second slot component (120) such that pulling the first end of the second cord (230) shortens the usable length of the second cord (230) and pulling the second end of the second cord (230) lengthens the usable length of the second cord (230);

h. a second clip (240) disposed at the second end of the second cord (230), configured to clip onto the bottom-wear (2000); and i. a second anchoring tab (250) disposed at the first end of the second cord (230), configured to lock the usable length of the second cord (230) in place.

2. The device (100) of claim 1, wherein the first slot component (120) further comprises a first hook component, wherein the second slot component (220) further comprises a second hook component, wherein the first anchoring tab (150) comprises a first loop component configured to attach to the first hook component, wherein the second anchoring tab (250) comprises a second loop component configured to attach to the second hook component.

3. The device (100) of claim 1, wherein the first cord (130) comprises one or more plug components disposed along a length of the first cord (130), configured to block the first cord (130) from pulling through the first hole (121), the second hole (122), or a combination thereof.

4. The device (100) of claim 1, wherein the second cord (230) comprises one or more plug components disposed along a length of the second cord (230), configured to block the second cord (230) from pulling through the first hole (221), the second hole (222), or a combination thereof.

5. The device (100) of claim 1, wherein the base component (110) comprises a movable fleece casing configured to reduce contact and friction of the base component (110) against the shoulders and neck of the user (1000).

6. The device (100) of claim 5, wherein the device (100) is configured to be continuously worn.

* * * * *